US005092383A

United States Patent [19]

Niemeijer et al.

[11] Patent Number: 5,092,383

[45] Date of Patent: Mar. 3, 1992

[54] SHADE FOR NON-RECTANGULAR OPENING

[75] Inventors: Remmelt C. Niemeijer, Ebenschede, Netherlands; Ren Judkins, Salt Lake City, Utah

[73] Assignee: BW-USA, Inc., Pittsburgh, Pa.

[21] Appl. No.: 32,632

[22] Filed: Apr. 1, 1987

[51] Int. Cl.[5] ..... E06B 3/94

[52] U.S. Cl. ..... 160/84.1; 160/134; 160/168.1

[58] Field of Search ..... 160/84 R, 134, 166.1, 160/168.1; 240/97, 95

[56] References Cited

U.S. PATENT DOCUMENTS 451,068 4/1891 Park ..... 160/84 R
3,946,788 3/1976 van Muyen ..... 160/84 R

FOREIGN PATENT DOCUMENTS 0058459 8/1982 European Pat. Off. ..... 160/84 R

*Primary Examiner*—Blair M. Johnson
*Attorney, Agent, or Firm*—Wolf, Greenfield & Sacks

[57] ABSTRACT

The invention relates to a pleated shade for a triangular or other non-rectangular opening. The shade has a fixed bar which is shaped and angled to conform to at least a portion of a first edge of the opening and a moveable bar shaped, positioned and angled to conform to a second edge of the opening when the shade is in its closed position. Pleated material is connected at one end to the fixed bar and at the other end to the moveable bar and is adapted to cover the opening when the shade is in its open position. At least one row of openings is formed in the material which openings are aligned to conform to the preferred directions of movement of the shade, and cords passing through the row of openings are adapted to control stacking of the material. Normally, second cords are also provided to open and close the shade. Means are provided for connecting the first and second cords in a manner to compensate for differences in the rate of travel of the cords when the cords are operated. Where the upper edge of the opening is not straight, the moveable bar may be formed of a flexible material so that it can bend to conform to the shape of the upper edge of the opening when the shade is in its open position. When a shade has both a rectangular portion and a non-rectangular portion, a middle bar may be provided at the junction. Cord means are provided for raising the rectangular portion of the shade to a position adjacent to the middle bar and then for pivoting the bottom bar and the middle bar together into a position parallel with the fixed bar.

42 Claims, 9 Drawing Sheets

SHADE FOR NON-RECTANGULAR OPENING

This invention relates to shades or blinds and more particularly to pleated shades adapted to cover non-rectangular openings.

BACKGROUND OF THE INVENTION

For purposes of this invention a pleated shade shall be defined as a shade, blind, screen, curtain, or other similar member for covering an opening which, when in its opened condition to expose the opening, stacks generally along predetermined creases or lines. Pleated shades are generally formed from a web-type material which retains its folds, for example impregnated textile fabric, paper or board type material, metalized textile material, etc. Other materials may also be used such as plastics and metals. Such shades are for example shown in Dutch Patent 167,220 and in U.S. Pat. No. 3,946,788 entitled "Foldable Curtain Screen or Blind Construction and a Method for Producing a Curtain Blind Construction" issued Mar. 30, 1976, to Hendrik van Muyen. Other forms of pleated shades include, but are not limited to, the various honeycomb and other shade configurations shown in co-pending application Ser. No. 030167 entitled "Shade and Method For the Manufacture Thereof", filed Mar. 25, 1987, and romans-style shades. In such shades, the material is attached between a horizontal headrail and a horizontal bottomrail, and the bottomrail is moved up and down under control of cords to uncover or cover the opening. Such a configuration is thus suitable only for covering a substantially rectangular opening and is not suitable for covering openings having triangular or other non-rectangular shapes. Since architects frequently design windows having non-rectangular shapes either to achieve a desired aesthetic effect or because of structural or functional limitations, a need exists for a pleated shade construction which can be used to cover such non-rectangular openings.

SUMMARY OF THE INVENTION

In accordance with the above, this invention provides a pleated shade which is operable between an open position to expose an opening and a closed position to cover the opening, the opening having a non-rectangular shape. The shade includes a fixed bar shaped and angled to conform to at least a portion of a first edge of the opening and a moveable bar shaped, positioned and angled to conform to a second edge of the opening when the shade is in its closed position. Pleated material is connected at one end to the fixed bar and at the other end to the moveable bar and is adapted to cover the opening when the shade is in its open position. At least one row of openings is formed in said material which openings are aligned to substantially conform to a perferred direction of movement of the shade when the shade is being opened. First cords are provided passing through each of said rows of openings and the bars adjacent to said rows of openings at each end thereof, the first cords being adapted to control the stacking of the pleated material, and second cords are provided which are adapted when operated to open and close the shade. Means are provided for connecting the first and second cords in a manner that compensates for the differences in the rate of travel of the cords when the cords are operated. For shades which are triangular or arch shaped, the openings through which the first cords pass would be radial or, for shallow angles, at an angle approximating the radial.

For preferred embodiments of such shades, the fixed bar would be an upper bar and the moveable bar a lower bar. The bars would be pivotably linked at their ends nearest each other and the moveable bar would be pivoted about the pivot point so that the two bars are substantially parallel to each other when the shade is in its open position. Where the upper side of the opening to be covered is curved, the lower bar may be formed of a flexible material which bends to conform to the shape of the upper edge when the shade is in its fully opened position.

For openings to be covered which have both a rectangular portion and a non-rectangular portion so that there is a spacing between the fixed and moveable bars at their near ends, at least some of the second cords are operative to raise and lower the moveable bar in a substantially vertical direction through its travel from a fully closed position to a selected point between the open and close position and at least some of the second cords are operative thereafter to move the lower bar in a substantially radial direction. The same second cords may for some shades control movement through both the rectangular and non-rectangular portions. Certain cords may also function as first and second cords for some shades. An intermediate bar means may be connected to the material at substantially the point where vertical travel ends and pivotal travel begins and may be pivotably linked to the fixed bar. Both the moveable and intermediate bars will pivot through the portion of shade travel where the shade is being pivoted.

The foregoing and other objects, features and advantages of the invention will be apparent from the following more particular description of preferred embodiments of the invention as illustrated in the accompanying drawings.

IN THE DRAWINGS

DETAILED DESCRIPTION

Figure 1:
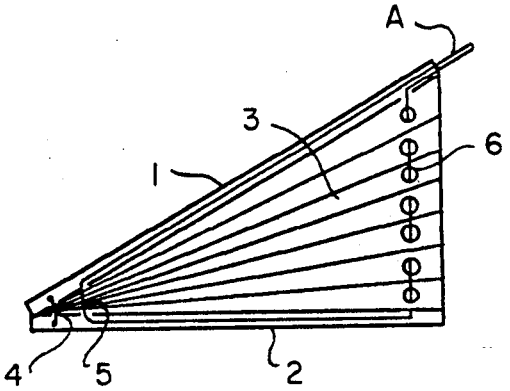
FIG. 1 is a front, partially cut-away view of a triangular shade of a first embodiment of the invention in which the material consist of a single sheet.

Referring first to FIGS. 1 through 10, a triangular shade according to invention consists of a conventional upper bar or headrail 1, a conventional lower bar or bottomrail 2 and one or more sheets of material folded in a pleated or zigzag shape.

Furthermore, one or more pulling cords is/are present which emerge to the outside at one end of the upper bar 1 in order to be operated. All this is conventional and corresponds for example to the structure shown in the beforementioned Dutch Patent 167,220.

The upper bar 1 is fixed along the upper edge of the window or other opening to be covered (which is not shown) and the lower bar 2 can be let down or pulled up.

The triangular window which is to be covered has the shape of a right-angled triangle with a horizontal and a vertical boundary and with an oblique upper edge. The shade in FIG. 1 may be used for such a window provided the horizontal width and the angle at the pivot point are not too great.

For shades which are too wide for a single sheet of standard width, the shade may be constructed from a number of sheets of the same or different widths which loosely overlap each other at the ends. In the overlaps, openings are present through which the pulling cords extend. This is also known from the beforementioned Dutch and United States patents.

According to the invention, the upper bar 1 and the lower bar 2 are pivotably linked at their ends which are closest together. This pivot may act directly on the upper and lower bar, but it may also be formed by a short piece of cord or the like 4 which extends through openings lying in one line, in upper bar 1, material 3 and lower bar 2 and which terminate at each end in a knot or other stop means. In the construction in FIG. 1, two further rows 5 and 6 of openings are provided.

Figure 12A:
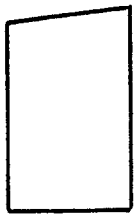
FIGS. 12A–12G are schematic representations of various additional non-rectangular openings which may be covered utilizing the teachings of this invention.
Figure 12B:
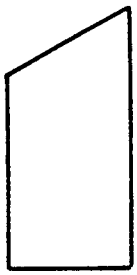
Figure 12C:
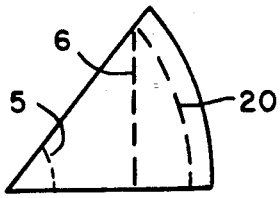

The sheet of material 3 is initially a rectangular pleated piece of material with the row of openings 5 being vertically aligned. When the material is pinched at its left end as shown in FIG. 1, row of openings 5 become aligned radially in an arc having its center of curvature at the pivot point. If uncut, the piece of material when pinched would have an arch shape generally as shown in FIG. 12C. However, the right hand or free boundary of the sheet 3 is cut to provide a straight vertical edge which corresponds to the right hand edge of the opening to be covered. The row of openings 6 runs parallel to this straight boundary and are also vertically aligned. While the shade shown in FIG. 1, and in most of the remaining figures, have the free boundary on the right side, it is apparent that the shade could also be oriented with the free boundary on the left side.

The pulling cord A formed into a closed loop runs through the upper bar 1, down through the row of openings 5, through the lower bar 2 to the right and back up and out through the row of openings 6. The loop A can move freely through both bars and through the material.

When the loop A is pulled, the lower bar 2 is pivoted towards the upper bar 1 and folds the material 3 together. Bars 1 and 2 are substantially parallel when the shade is in its open position.

Figure 2:
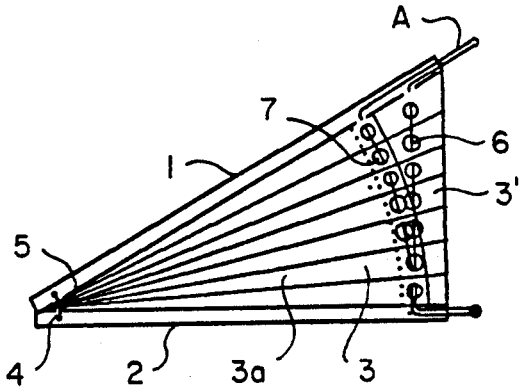
FIG. 2 is a front, partially cut-away view of a triangular shade in which the material consist of a rectangular sheet and of a substantially triangular sheet.

As shown in FIG. 2, the material 3 can also be constructed in two parts. The first and largest part is formed by a rectangular sheet 3*a* with rows of openings 5 and 7 at respective ends, the one row 5 being used for the pivoting cord 4. The sheet 3*a* is fanned to form an arched section and to cause the rows of openings 5 and 7 to each be radially aligned. The second, smaller part is formed by the cut, more or less triangular, sheet 3′ with the row of openings 6.

In the sheet 3*a* and the sheet 3′ there is a row of openings 7 which overlap each other. The cord loop A is fed through the rows of openings 6 and 7 and secured on the end to the lower bar 2. The cord passing through the openings 7 holds the sheets 3*a* and 3′ together.

Figure 3:
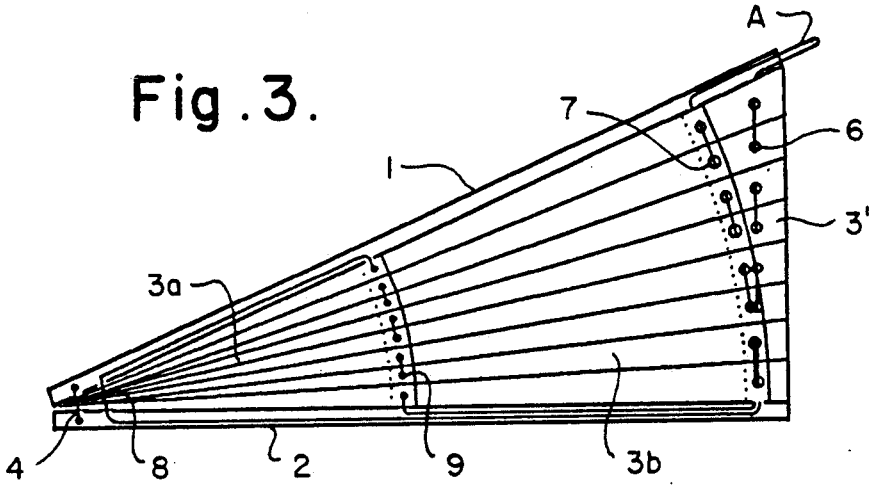
FIG. 3 is a front, partially cut-away view of a triangular shade of this invention having two rectangular sheets of material which overlap and a triangular sheet with one closed cord loop.
Figure 4:
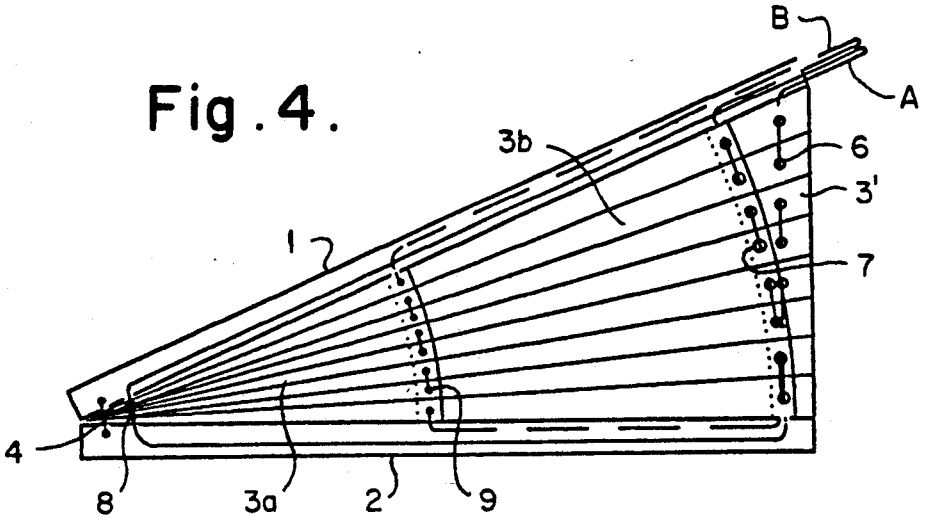
FIG. 4 is a front, partially cut-away view of an embodiment of the invention which is the same as that shown in FIG. 3 except that is utilizes two closed cord loops.

The structure in FIG. 3 and FIG. 4 consists of two rectangular sheets indicated by 3*a* and 3*b* and of a more or less triangular part 3′. The left-hand sheet 3*a* contains on the left a row of openings for the pivoting cord 4, and in addition a row of openings 8 and on the right a row of openings 9 which are overlapped by the left-hand side of the sheet 3*b*. The sheet 3*b* contains on the right the row of openings 7 which are again overlapped by the openings 7 of the more or less triangular sheet 3′ which sheet also has the vertical row of openings 6.

In FIG. 3, one cord loop A is used which runs down through the row 6, through the lower bar 2 completely to the left up through the row 8, through the upper bar 1 to the right, down through the row 9, through the lower bar 2 to the right, up through the row 7 and out through the upper bar 1.

In FIG. 4, two cord loops A and B are used. This provides smoother operation and is preferable. Loop A goes down through row 6, through bar 2 completely to the left, up through row 8 and through bar 1 to the right and out. Loop B goes down through row 7, through bar 2 to the left, up through row 9 and out through bar 1. The loops A and B are linked by a cord D (FIG. 11) which is threaded over a freely rotating pulley or roller 12 in a holder 13 by means of which the shade can be operated. In this manner, a compensation is produced for the differences in the distance through which the loops A and B move and their different rates of travel.

Figure 5:
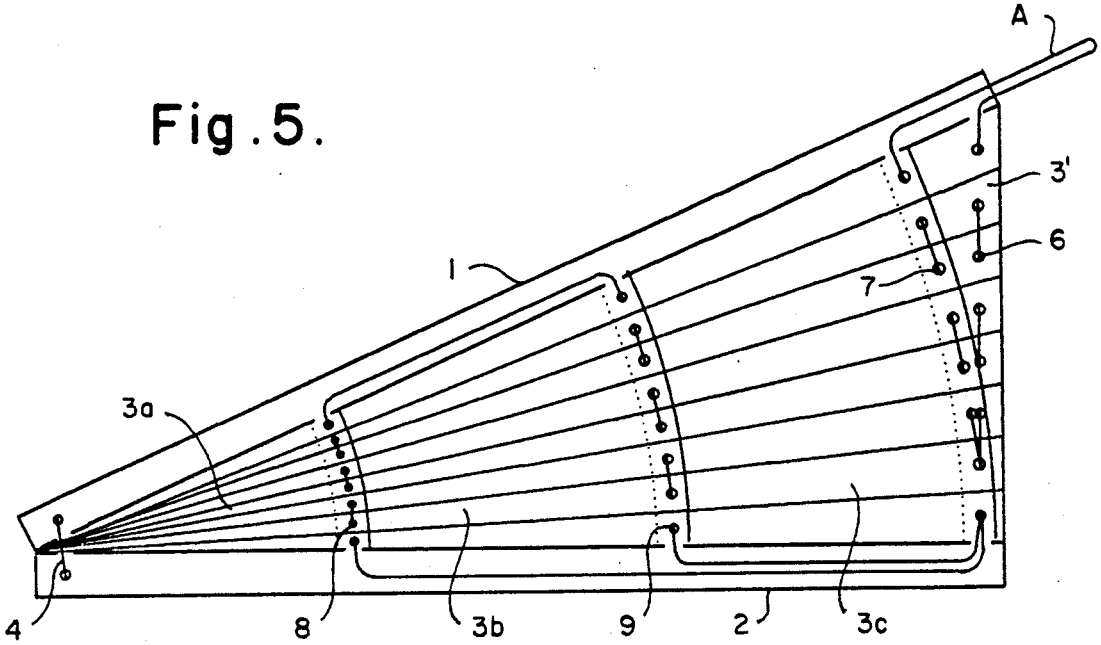
FIG. 5 is a front, partially cut-away view of an embodiment of the invention which is the same as that shown in FIG. 3 except that it utilizes three rectangular sheets of material.
Figure 6:
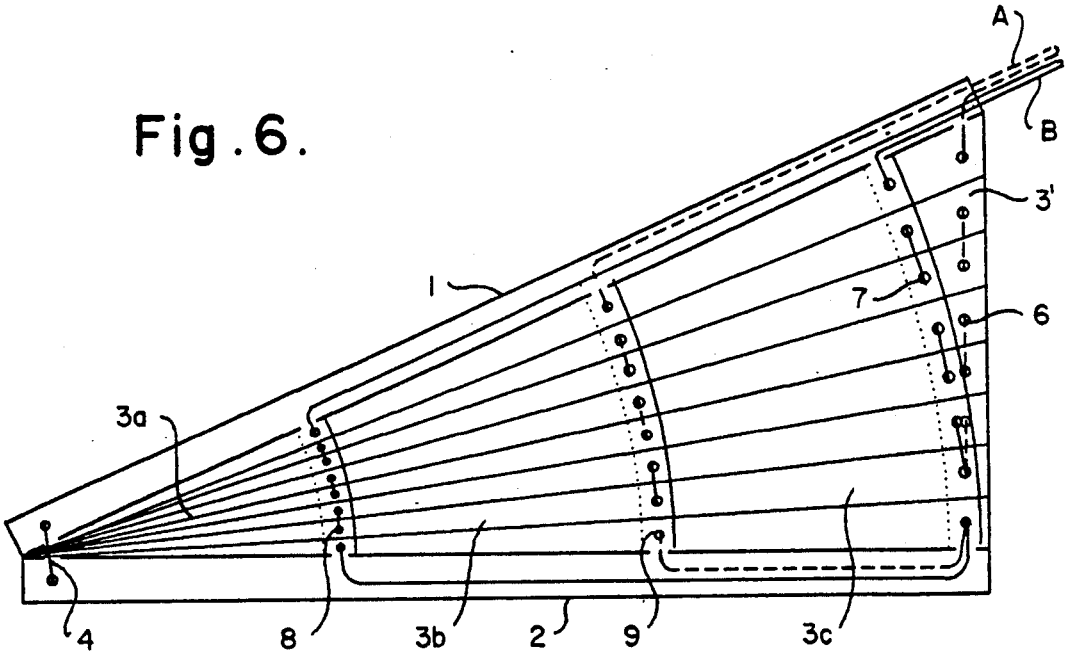
FIG. 6 is a front, partially cut-away view of a triangular shade which is the same as that shown in FIG. 5 except that it utilizes two closed cord loops.
Figure 7:
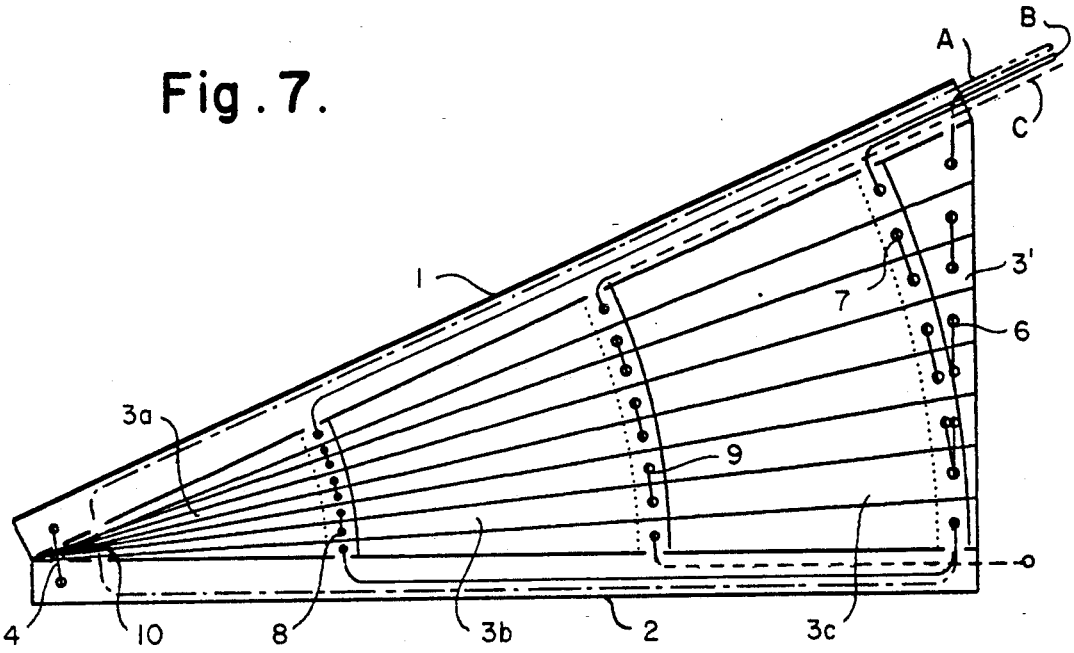
FIG. 7 is a front, partially cut-away view of a triangular shade which is the same as that shown in FIG. 5 except that it utilizes two closed cord loops and one open cord.

In the structure in FIGS. 5, 6 and 7, three rectangular sheets 3*a*, 3*b* and 3*c* are used and a more or less triangular sheet 3'.

In FIG. 5, one cord loop A is used which goes down through the row 6, to the left in the lower bar 2, up through the row 9, through the upper bar 1 to the left, down through the row 8, through the lower bar 2 to the right, up through the row 7 and out through the upper bar 1.

Figure 11:
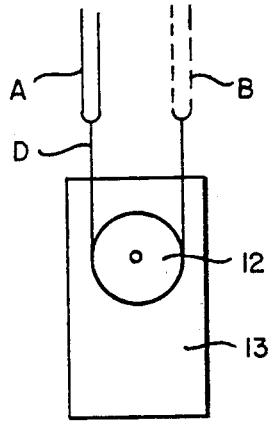
FIG. 11 is a front view of a pulley means suitable for use with embodiments of the invention having two or more cords or cord loops.

In FIG. 6, two cord loops A and B are used. Cord loop A runs down through row 6, to the left through the lower bar 2, up through row 8 and through upper bar 1 to the right and out. Cord loop B runs down through row 7, through bar 2 to the left, up through row 9 and through bar 1 to the right and out. Here, too, the compensation means in FIG. 11 is used.

In FIG. 7, two cord loops A and B and a cord C are used. The sheet 3*a* has a further row of openings 10. Cord loop A runs down through row 6 and through bar 2 to the left, up through row 10 and through bar 1 to the right and out. Cord loop B runs down through row 7, through bar 2 to the left, up through row 8 and through bar 1 to the right and out.

A cord C which is not closed to form a loop runs through the upper bar 1 to the left, down through the row 9 and through the lower bar 2 to the right where it is secured to a right-hand end. Here, too, the two loops A and B are linked by the cord D, while the cord C is linked to one of the loops A and B.

Figure 8:
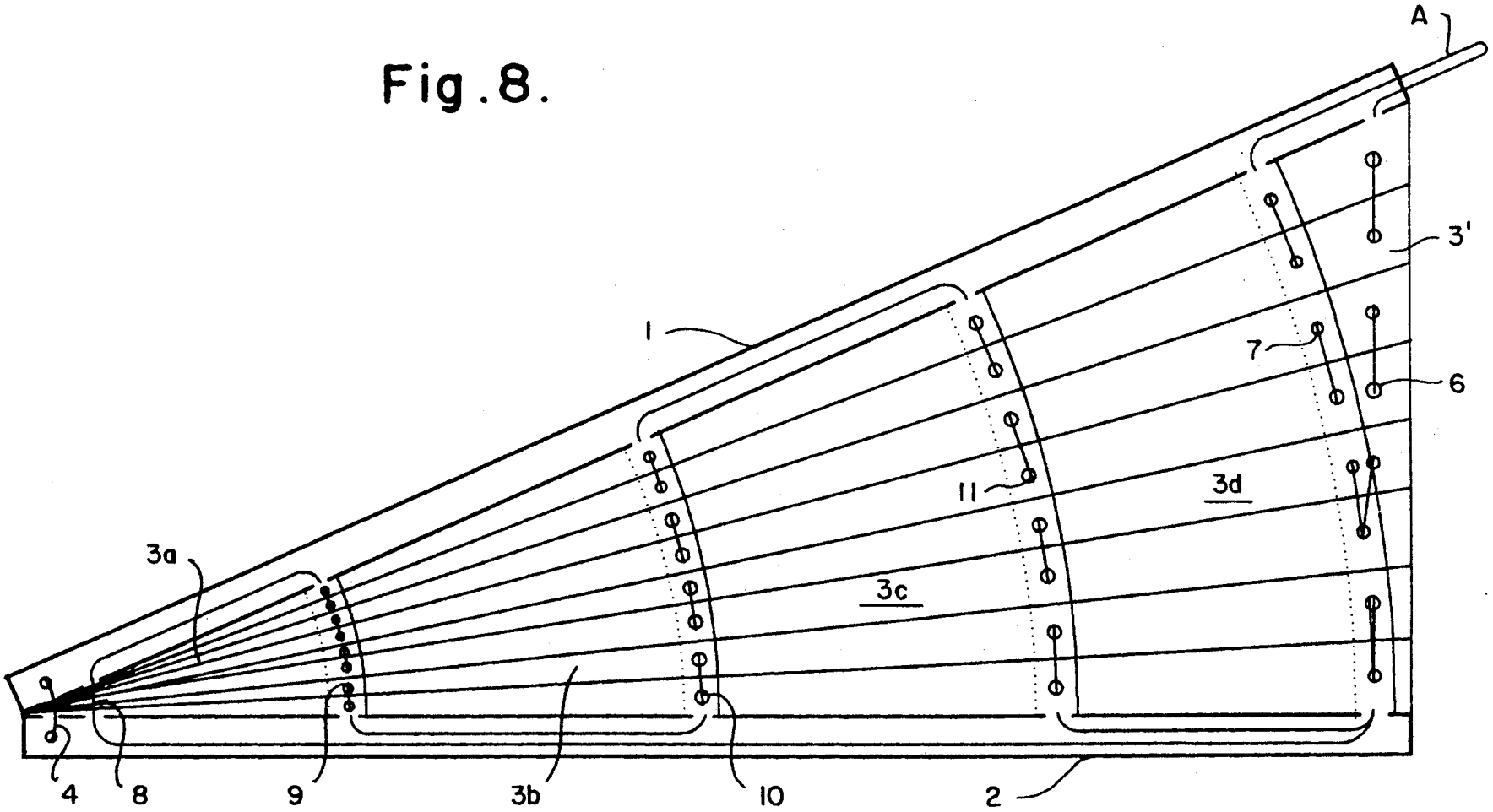
FIG. 8 is a front, partially cut-away view of a triangular shade which is the same as that shown in FIG. 5 except that it utilizes four rectangular sheets.
Figure 9:
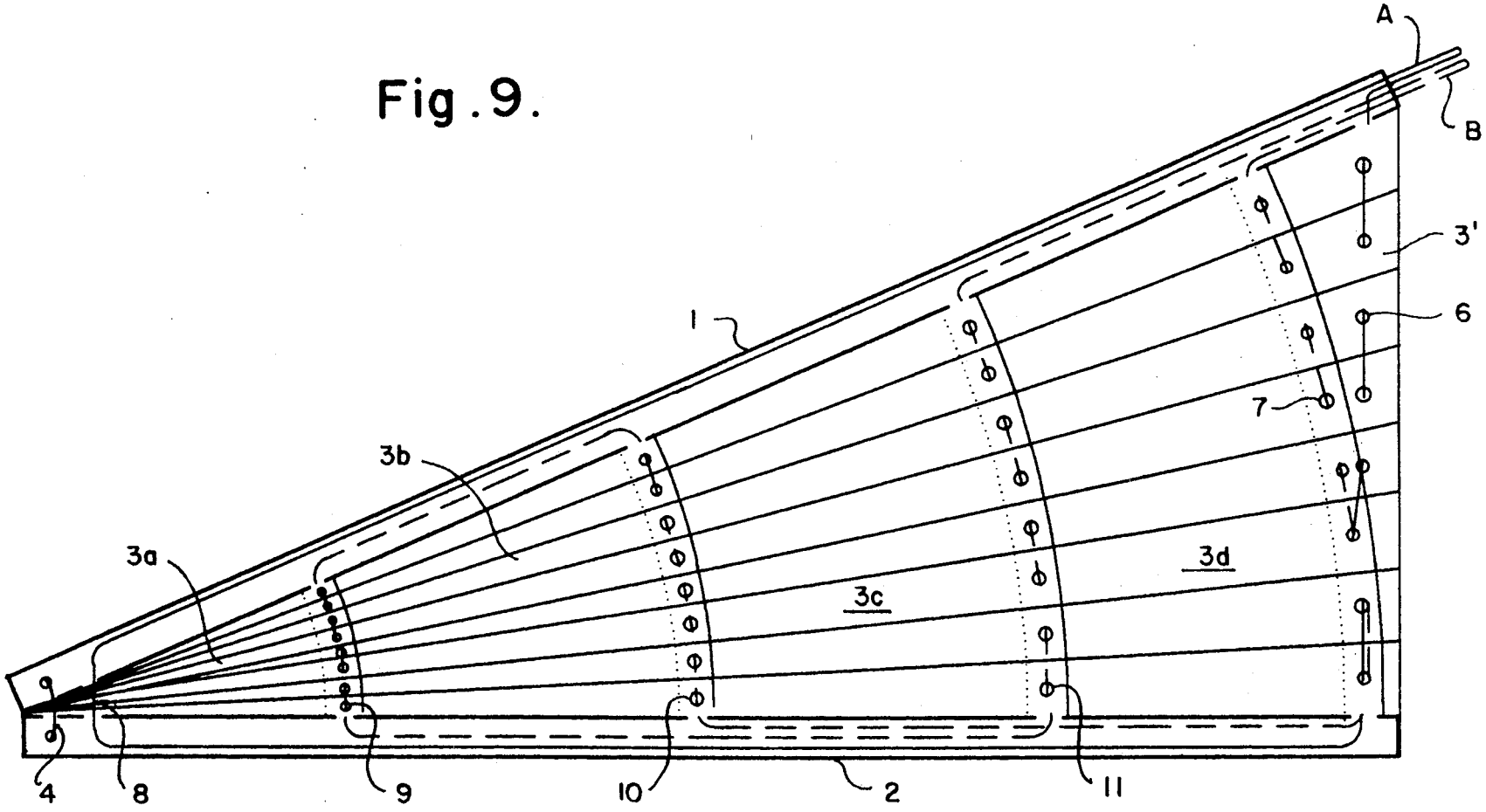
FIG. 9 is a front, partially cut-away view of a triangular shade which is the same as that shown in FIG. 8 except that it utilizes two closed cord loops.
Figure 10:
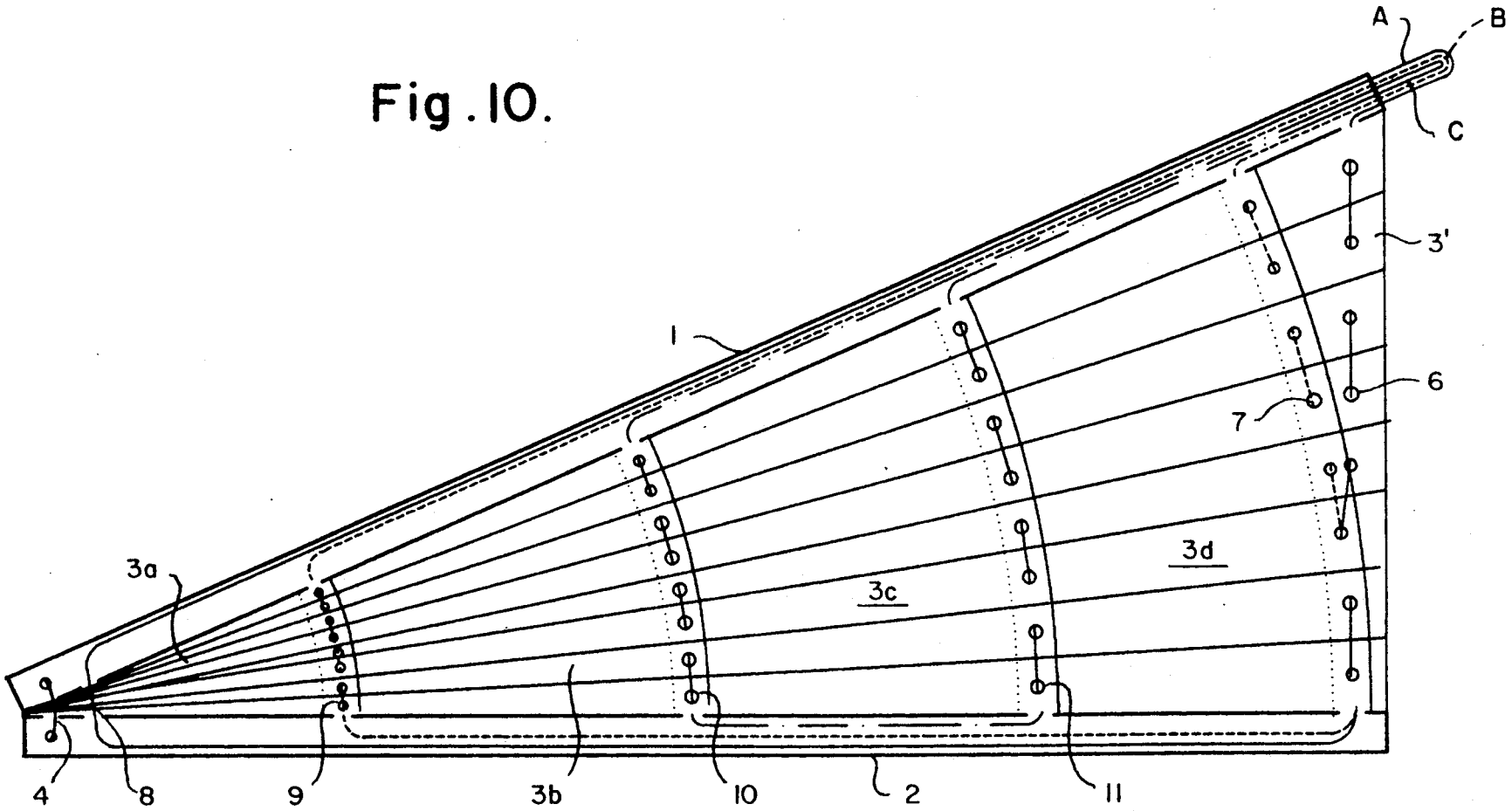
FIG. 10 is a front, partially cut-away view of a triangular shade which is the same as that shown in FIG. 8 except that it utilizes three closed cord loops.

In the embodiments in FIGS. 8, 9 and 10, four rectangular sheets 3*a*, 3*b*, 3*c* and 3*d* are used, as well as an approximately triangular sheet 3'.

In the embodiment in FIG. 8, one cord loop A is used which runs down through the row 6, through the bar 2 completely to the left, up through the row 8, though the bar 1 to the right, down through the row 9, through the bar 2 to the right, up through the row 10, through the bar 1 to the right, down through the row 11, through the bar 2 to the right and up through the row 7.

In the embodiment in FIG. 9, loops A and B are used. Loop A goes down through row 6, through bar 2 completely to the left, up through row 8 and through bar 1 to the right. Loop B goes down through row 7, through bar 2 to the left, up through row 10, through bar 1 to the left, down through row 9, through bar 2 to the right, up through row 11 and through bar 1 to the right. The movement paths of the loops A and B are again compensated for by a device according to FIG. 11.

In the embodiment in FIG. 10, three loops are used. Loop A goes down through row 6, through bar 2 to the left, up through row 8 and through bar 1 to the right. Loop B goes down through row 7, through bar 2 to the left, up through row 9 and through bar 1 to the right. Loop C goes down through row 11, through bar 2 to the left, up through row 10 and through bar 1 to the right.

If the sheets 3*a*–3*d* have the same width, then the loops B and C move over the same distance. They can thus be linked together to the one end of the compensation cord D while the loop A is linked to the other end of cord D.

The width of the shade structure can be increased by using more rectangular sheets. The cord feeding system remains in principle the same.

The cord loops and generally the cord are simultaneously operated by the same handle or other controller and, to the extent they are operated from a single controller, are linked to each other via a compensating means such as that shown in Figure 11.

In the discussion of FIGS. 1–11, it is seen that each of the shades utilizes both straight or vertical cords which pass through the row of openings 6 and one or more radial cords which pass through rows of radial openings. In these embodiments, the cord passing through the straight row of openings 6 is the lift cord and is primarily responsible for raising lower bar 2 from the closed position shown in the figures to the open position with the two bars substantially parallel to each other and the sheet or sheets of material compressed and folded therebetween. The cords passing through the radial rows of openings perform at least one and in some cases two functions. The first function is to guide and hold the stack, particularly when the shade is in its closed position as shown in the figures, so that a desired shape for the shade is maintained. While the cords passing through the radial openings can support some of the load, an attempt to have the load handled by these cords alone for shades other than ones having a very shallow angle at the pivot point could result in a crinkling of the material.

FIGS. 1–11 illustrate a special case of non-rectangular opening, namely a right-angle triangle. It is apparent that shades are required for covering windows or other openings having a variety of other non-rectangular shapes. Figures 12A–12G illustrate a number of such shapes. FIG. 12A is an opening with a generally rectangular opening but with a shallow slant top. This angle might be less than 12°. FIG. 12B is also a generally rectangular opening with a slant top, but the angle of the slant is greater, typically 12° to 60°. The manner in which shades in accordance with teachings of this invention are designed for covering these two openings will be described in greater detail in conjunction with FIG. 17.

FIG. 12C is a one-third arch opening and is the same as FIG. 1 except that the free boundary or right edge of the shade has not been cut. A shade for an opening of the type shown in FIG. 12C would, in addition to the row of radial openings 5 and the straight row of openings 6, also require a row of radial openings 20 to maintain the shape of the shade. A single cord loop could pass through all of the openings 5, 6 and 20 or a cord loop could pass through rows 5 and 20 and a single lifting cord could pass through row 6. These cords could be connected as shown in FIG. 11 or in other suitable manner to compensate for the difference in length and rate of travel of the two cords.

Figure 12D:
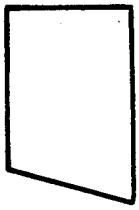
Figure 12E:
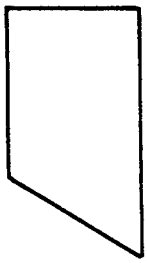
Figure 12F:
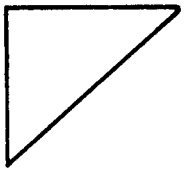

FIGS. 12D and 12E show openings which are generally rectangular but have a slanted bottom edge. In FIG. 12D the bottom edge has a shallow slant, generally under 12°, while in FIG. 12E, the slant is more substantial, being in the range of 12° to 60°. The manner in which a shade for these openings may be constructed will be discussed in conjunction with FIGS. 18A and 18B. FIG. 12F is a triangular shade with the hypothesis of the triangle on the bottom of the opening rather than on the top as shown in FIG. 1. The manner of developing a shade to cover this opening will also be discussed in conjunction with FIGS. 18A and 18B.

Figure 12G:
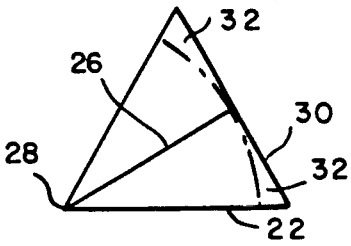

FIG. 12G shows a more general case of a triangular opening where the opening is in the form of an equilateral triangle rather than a right triangle. The problem with designing a shade to cover the opening 12G is that the edges 22 and 24 of the opening are longer than the line 26 extending from pivot point 28 perpendicular to side 30. Therefore, if this shade is to operate in the same manner as the shades of FIGS. 1 and 12C, and the shade were to cover the entire opening, the bar or bottomrail 2 would extend beyond the edge of side 30 when the shade was being raised and lowered. The shade could thus not be used with an inside hang, but could be used if the shade were positioned outside the opening. Another option would be for the shade to be only as long as line 26 along edges 22 and 24, thus having a quarter arch shape as shown FIG. 12C and leaving two small exposed portions 32 which could be covered with a valance. In either case, the shade would operate in substantially the same manner as described above with respect to FIG. 12C.

Figure 17:
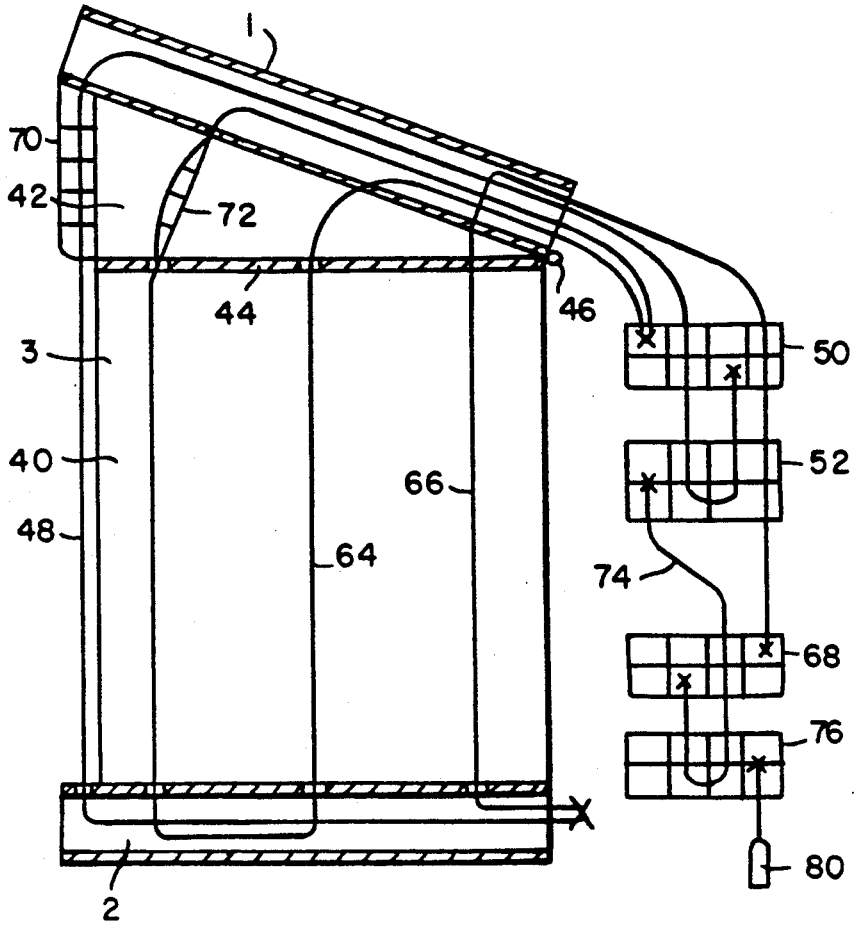
FIG. 17 is a schematic, partially cut-away front view of a shade for the opening shown in FIG. 12B.

FIG. 17 illustrates schematically a shade suitable for use with a slant-top opening of the type shown in FIG. 12B. For purposes of illustration, the slant in FIG. 17 is in the opposite direction from that in FIG. 12B and it should be understood that for this embodiment of the invention, and for the other embodiments discussed, the slant top or slant bottom can be in either direction without altering the teachings of the invention. Further, in FIG. 17, neither the pleats in the shade nor the cord openings through the material have, for simplicity of illustration, been shown, but it is to be understood that the rectangular portion 40 of this shade is pleated in the same manner as for a standard pleated shade and that the triangular portion 42 of this shade is pleated in the same manner as that of FIG. 1. Each of the cords shown in this figure which is internal to the shade passes through a row of cord openings of the type shown in FIG. 1.

The shade in FIG. 17 has a headrail 1 and bottomrail 2 with a sheet of material 3 connected therebetween. As with the embodiments previously described, the headrail and footrail are of conventional design. Sheet of material 3 may be a single sheet of material or separate sheets of material may be used for regions 40 and 42 which sheets of material are spliced together by suitable means. One method of splicing two sheets of pleated material together is shown in the beformentioned copending application Ser. No. 030167. In addition to the rails 1 and 2, the shade of FIG. 17 also preferably has a middlerail 44. This rail supports the material section 42 at its bottom and material section 40 at its top and may be used if desired in splicing together two sheets of material or to cover a splice joint. Rail 44 is secured to the rear of the shade by sewing, clamping or other conventional means. Rail 44 is hinged to headrail 1 by a hinge member 46. In the alternative, the hinge joint between rails 1 and 44 may be formed by a hinge cord 4 in the manner shown in FIG. 1 and previously described.

In the shade of FIG. 17, there are a number of functions which must be performed by cords or equivalent elements and which may be performed in a variety of ways. The functions include (a) supporting and lifting bottomrail 2; (b) controlling the stacking of the material in rectangular area 40; (c) supporting the middlerail 44; (d) lifting the middlerail; (e) controlling the stacking of the material in triangular area 42; (f) controlling the descent of bottomrail 2.

The last function, controlling the descent of the bottomrail, requires some explanation. In operation, rail 2 is normally lifted until it comes adjacent to rail 44 and then, as the shade continues to be raised, rails 2 and 44 pivot together about hinge 46 until they come adjacent and substantially parallel to rail 1. When the shade is lowered, this process should be reversed. However, when tension is released on the cords, there is normally a tendency for rails 2 and 44 to start separating before rail 44 reaches the horizontal position shown in FIG. 17. This results in bottomrail 2 starting its descent at an angle and in the left edge of the rail and the material adjacent thereto rubbing against the wall of the opening during a substantial portion of the descent. This could also cause kinking of the material. It is therefore necessary to control the descent of the shade so that rails 2 and 44 stay adjacent to each other until rail 44 has substantially reached its horizontal position.

FIG. 17 shows one cording arrangement which may be utilized to accomplish the various functions described above. In FIG. 17 the lifting function for the bottomrail 2 is accomplished in major part by lift cord 48 which terminates at one end on the right side of bottomrail 2 and extends from that point to the left through the bottomrail and up along the outside of the left edge of sheet 3 into headrail 1, to the right through headrail 1 and through a pair of guide holes in a multiple-cord pull, guide and stop element (MPG) 50 and is looped around a pulley in MPG 52, terminating in MPG 50.

Figure 19:
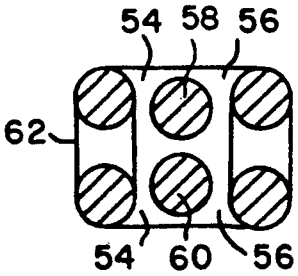
FIG. 19 is a cut-away side view of a multiple-cord pull, guide and stop suitable for use with various embodiments of the invention.

The MPG's are shown diagrammatically in FIG. 17. Each MPG is a relatively small, generally cube-shaped block of plastic or other suitable material having four openings in its top, a corresponding four openings in its bottom, and one opening in each of its sides. A cross-section of an MPG is shown in FIG. 19. Cords may pass through the channels defined by openings 54 and 56 (which are two of the four cord guide channels in the MPG). Studs 58 and 60 serve both to define the guide channels and as pulleys over which a cord may be passed, as for example the cord 48 in the MPG 52. Thus, a cord may pass in through top opening 54, loop over pulley 58, and pass out through top opening 56 while a second cord may come in either through the bottom openings and loop over pulley 60, or may come in through one of the other two openings and loop over either pulley and out through the other top opening. A cord may be terminated by, for example, coming in through top opening 54 and passing out through side opening 62. The cord passing out through openings 62 may be knotted, attached to a ring or washer or otherwise terminated. Two cords may be joined in a MPG by terminating each cord at the device. The openings 62 may be large enough so the knotted end of a terminated cord will pass through opening 62 but be held by the two studs defining the channel through which the cord entered.

It is noted that cord 48 passes along the left edge of material 3 rather than through the material and this cord therefore does not require cord openings in the material. Cord 48 therefore functions only to lift bottomrail 2 and does not function to control the stacking of the shade as would a cord passing through openings in the material.

A cord 64 is provided in the form of a closed loop. One end of the loop is secured to a first hole 62 in MPG 50 and extends to the left through headrail 1, down through a radial set of openings in portion 42 of the material, through middlerail 44, through a straight vertical row of openings in section 40 of the material, into bottomrail 2, to the left through the bottomrail, up through a straight row of openings in portion 40, through middlerail 44, through a radial set of openings in portion 42, into headrail 1, to the right through the headrail and terminates through the same or a different opening 62 in MPG 50. Cord 64 can provide some lift to bottomrail 2 and middlerail 44 but, as will be discussed shortly, the timing is such that this cord does not support substantial weight. The function of this cord is primarily to control the stacking of both portions of the material. If substantial weight were put on this cord, it might cause a crinkling of the material in the portion 42.

Descent of bottomrail 2 is controlled by cord 66 which terminates at one end at the right edge of bottomrail 2, extends to the left through the bottomrail, extends up through a straight row of openings in portion 40, through a straight, angled or radial row of openings in, portion 42, to the right through headrail 1, through MPG's 50 and 52 and terminates in MPG 68. In addition to controlling descent, cord 66 is also utilized to lift bottomrail 2 and to control the stacking of section 40.

The cords described so far support the bottomrail, but may not support middlerail 44. This function can be performed by a spacer 70 and/or a spacer 72. A spacer is a cord, plastic strap, strip of material, or other suitable element of fixed length which is secured at one end to headrail 1 and at the other end to middlerail 44. One potential problem with a spacer is that, when the shade is in its up or open position, the spacers tend to bow out in the back into a single large loop which may not be aesthetically acceptable in some applications. Spacers which overcome this problem are described in co-pending application, Ser. No. 032,623 filed Apr. 1, 1987, in the name of Ren Judkins. These spacers may be in the form of braided cords with loops projecting at intervals therefrom. As shown in FIG. 17, a cord, such as cord 48 or 64, may pass through these loops so that, when the shade is raised, the spacer collapses into a number of small loop sections which are not readily visible, rather than into a single large aesthetically unappealing loop. As shown in FIG. 17, spacer 70 is adjacent to the left edge of the shade, running along cord 48, while spacer 72 is behind the shade. Spacers do not need to pass through cord openings in the shade.

Cord 74 is a timing cord which assures that cord 66 will not permit the separation of rails 2 and 44 until rail 44 has been rotated to substantially its horizontal position as shown in FIG. 17. Cord 74 is attached at its upper end through an opening 62 in MPG 52, passes through a pair of openings, for example opening 56, in MPG 68, is looped in MPG 76 and terminates through an opening 62 in MPG 68. The final element in the shade is pull cord 78 which is attached at one end through a hole 62 in MPG 76 and terminates at the other end in a tassel 80.

In operation, with the shade in its down or closed position, the user pulls tassel 80, causing MPG 76 to be moved downward. Cord 74 which is looped through MPG 76 is attached at one end to MPG 68 and at the other end to MPG 52 causing both these MPGs to be lowered. Since the tendency will be to have both lengths of cord 74 equal, MPG 52 will be moved initially slightly faster than MPG 68 to bring these two MPGs substantially into stacking contact with each other. Since cords 48 and 66 are attached to MPGs 52 and 68 respectively, these cords will be pulled up as the MPGs are lowered raising bottomrail 2. As MPG 52 is lowered, cord 48 attached thereto will also apply some force to MPG 50 lowering this MPG as well and therefore raising cord 64. However, most of the force exerted by MPG 52 on cord 48 will be applied to raise this cord and only a small part of the force will be applied to lower MPG 50. Therefore, loop 64 attached to MPG 50 will not have substantial load applied thereto and will serve mainly to control stacking of the material.

When the shade is in its raised position, MPGs 52 and 68 are, as previously discussed, stacked one on top of the other. When the cords are released, most of the weight of the rails acts on cord 48 causing MPG 52 to be raised as rails 2 and 44 rotate counterclockwise from their raised, stacked position adjacent slanted rail 1 to a horizontal position. MPG 68 is initially held by the operator. Timing cord 74 permits MPGs 52 and 68 to separate while MPG 68 is held. Cord 66 which is attached to MPG 68 thus serves to hold rails 2 and 44 together until these rails are in their horizontal position at which point cord 74 is fully extended causing MPG 76 to butt against MPG 68. MPG 68 is at this point released by the operator to move substantially in synchronization with MPG 52 as section 40 of the material is lowered to its fully closed position.

The MPGs thus serve to control the timing on the stacking and the unstacking of the shade. Depending on the size of the shade and on aesthetic considerations, the MPGs may be exposed along the cords on the side of the shade or may be fitted in a wand or channel which assures that they do not tilt or rotate and may be more aesthetically pleasing.

The configuration shown in FIG. 17 would be suitable for shades up to about 54 inches in width. Wider shades might require additional cords.

While in FIG. 17, cord 64 has served to control stacking in both section 40 and 42 of the shade, other configurations are possible. For example, one or more lift cords such as cord 48 may be positioned inside the material, passing through cord openings formed therein, and such straight cords might pass through both sections 40 and 42, performing the lift function in both sections and performing the stacking control function in section 40. Radial cords connected between headrail 1 and middlerail 44 may then control stacking in section 42 in much the same manner as in FIG. 1. It is also possible that different lift cords may be used for sections 40 and 42 and that lift cords may be either outside the shade as shown in FIG. 17 or may be attached in front and behind the shade rather than passing through openings formed therein. Further, if a timing arrangement using MPGs as shown in FIG. 17 is not utilized, the descender control function of cord 66 could be accomplished by providing a ball at the end of cord 66 which the user would grasp and hold when the shade was lowered until rails 2 and 44 reached the desired position.

With a shallow-angle slant top such as this shown in FIG. 12A, it may be possible to achieve the desired results using only straight cords with the holes in section 42 being slightly wider. It may also be possible to use cords which are angled at a tangent to the radial curve shown in FIG. 17 rather than radial cords. Of course, for wider shades, multiple sheets of a material could be combined as shown in FIGS. 2–10.

Figure 18A:
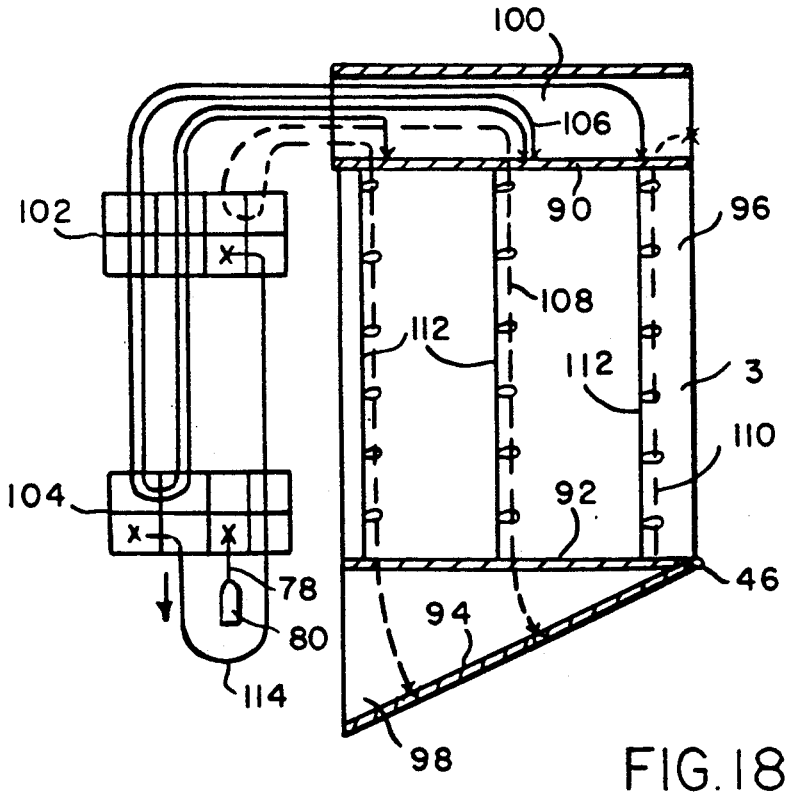
FIG. 18A is a schematic, partially cut-away front view of a shade for the opening, shown in FIG. 12E in its closed condition.
Figure 18B:
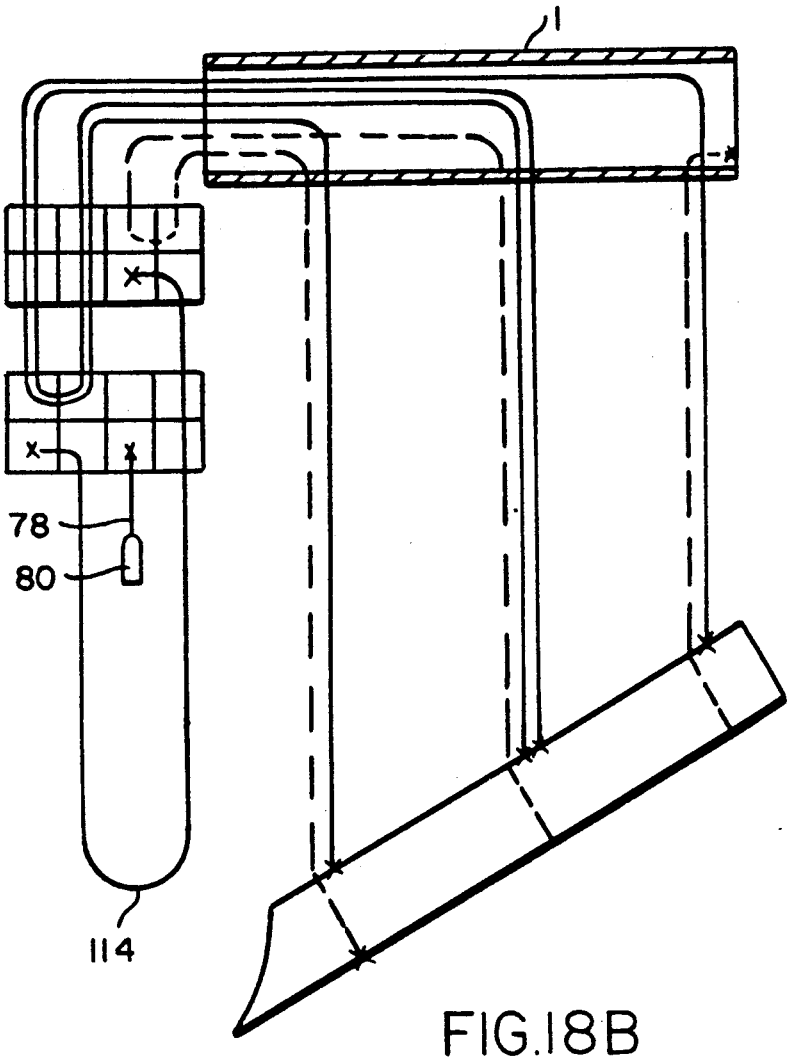
FIG. 18B is a schematic, partially cut-away front view of a shade for the opening shown in FIG. 18A in its open condition.

Referring now to FIGS. 18A and 18B, a shade for covering an opening having a slanted bottom is shown. As with FIG. 17, the representation of FIGS. 18A and 18B is schematic, not for example showing shade pleats or cord openings. The shade of this embodiment of the invention operate differently from those of other embodiments in that the shade is opened by lowering the shade from the top rather than raising it from the bottom. The shade includes a headrail 1 which is attached to the top edge of the opening, an upper rail 90 which is attached to the top of the sheet of material 3, a middlerail 92 which is similar in construction and function to the middlerail 44 of FIG. 17 and a bottomrail 94 which is fixed and is attached to the slanted bottom edge of the opening. Sheet of material 3 has a rectangular portion 96 and a triangular portion 98. As with the embodiment of FIG. 17, material 3 may be a single sheet of material or may be two sheets of material which are spliced together at the rail 92. Rails 92 and 94 are pivotably connected at their near ends by a hinge 46 or other suitable means.

The lifting cords for the shade are in two loops. The first loop 100 is attached to rail 90 near the right side thereof, extends to the left through headrail 1, passes through MPG 102, is looped through MPG 104, passes back through MPG 102, into and to the right in headrail 1 and attaches on the left side of rail 90. The second loop 106 starts near the center of rail 90, passes to the left through headrail 1, passes through MPG 102, loops through MPG 104, passes back through MPG 102, passes into and to the right through headrail 1 and terminates near the center of rail 90 at substantially the same point where the other end of the loop connects.

The stacking control cords are formed as a loop 108 and a single cord 110. The loop 108 starts near the left side of bar 94, passes through a row of radial openings (not shown) in portion 98 of material 3, passes through or over bar 92, passes through a vertical, substantially straight row of openings (not shown) in portion 96 of material 3, passes into and to the left in headrail 1, loops through MPG 102, passes to the right through headrail 101, passes through a substantially vertical, substantially straight row of openings near the center of portion 96, passes over or through rail 92, passes through a substantially radial row of openings near the center of portion 98 and terminates in a connection to a point near the center of rail 94. The stacking control cord 110 attaches near the right edge of rail 94, passes through a straight or radial row of openings in portion 98, passes through or over bar 92, passes through a substantially vertical, substantially straight row of openings on the right side of portion 96, passes into and to the right in headrail 1 and terminates on the right side of the headrail.

Three spacers 112 are provided which may for example be braided cords of fixed length with projecting loops at selected intervals of the type previously described in conjunction with FIG. 17. Cords 108 and 110 pass through the loops in spacers 112 to limit the size of the rear projecting loops formed by the spacers when the shade is open. Spacers 112 support rail 92 and are attached at one end to rail 90 and at the other end to rail 92. A cord 114 is attached at one end to MPG 104, loop below the MPG, passes through a channel in MPG 104 and terminates in MPG 102.

In operation, with the shade in its closed condition, cord loops 100 and 106 are released, the cord loops pull on MPG 104 raising this MPG and permitting the shade material 3 to drop under the force of gravity to the position shown in FIG. 18B. Note that since bar 94 is longer than bars 90 and 92, the final stack is slightly slanted on the left side. The cords also move slightly to the right as the shade stacks. Other than the slight movement to the right, there is little or no movement of the stacking control cords 108 and 110.

Since, as may be seen in FIG. 18B, when the shade is down, cords 108 and 110 are visible, any slack in these cords would be unattractive. Cord 114 is therefore provided which may be pulled when the shade has been fully dropped to take up any slack in cords 108 and 110. In the alternative, MPG 104 may be weighted or have a weight hung from it to automatically perform the same function.

To raise the shade, the user pulls on tassel 80 pulling MPG 104 down. This pulls down both cord loops 100 and 106 and results in a raising of the shade. Again, there is little or no movement of MPG 102 or of the stacking control cords.

For shades covering openings of the type shown in FIG. 12D, the operation would be substantially the same as that shown in FIGS. 18A and 18B except that the stacking cords might be straight all the way down or might be angled rather than radial. If the angle were shallow enough, so that the difference in length between bar 94 and bar 90 was minimal, it might be possible to operate this shade as a standard shade with slightly wider cord holes.

For an opening of the type shown in FIG. 12G, rail 92 would be adjacent to headrail 1 rather than bar 90 and spacers 112 would not be required. Otherwise, the operation would be substantially the same as that shown and described with reference to FIGS. 18A and 18B for the portion 98.

The cording shown in FIGS. 18A and 18B is of course for purposes of example only and other cording arrangements are possible. For example, loop 106 could be replaced with a single line which terminates at MPG 104 rather than being looped. The number of cords utilized for lifting and for stacking control vary with the width of the shade and additional sheets of material may be added, as is shown for FIGS. 2–10, where a single standard-width sheet is not sufficient.

Figure 13A:
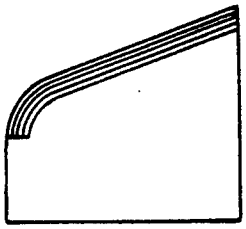
FIG. 13A is a schematic front view of a shade in its open position for an opening having a curved upper edge.
Figure 13B:
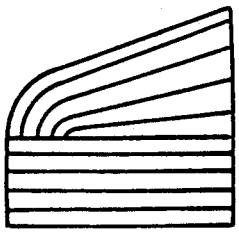
FIG. 13B is a schematic front view of the shade shown in FIG. 13A in its closed position.

In FIGS. 13A and 13B, the upper edge of the opening to be covered by the shade is slightly curved at one end in addition to being slanted. This shade could be constructed and corded in substantially the same manner as the shade of FIG. 17 except that bottomrail 2 and middlerail 44 would be formed of a flexible material such as plastic rather than of a rigid material. Thus, when the shade is in its fully open position as shown in FIG. 13A, these rails would bend to conform to the shape of the upper edge of the opening.

Figure 14A:
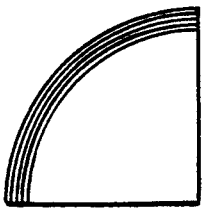
FIG. 14A is a schematic front view of a shade in its opened position for a half arch opening.
Figure 14B:
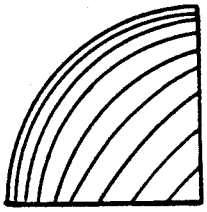
FIG. 14B is a schematic front view of the shade shown in FIG. 14A in its closed condition.

FIGS. 14A and 14B show still another embodiment of the invention wherein a bottomrail 2 would also be constructed of a flexible material. Other than for the flexible bottomrail which bends to conform to the curved shape of the upper edge of the opening, this embodiment of the invention would function in substantially the same way as the embodiment of the invention shown in FIG. 1.

Figure 15A:
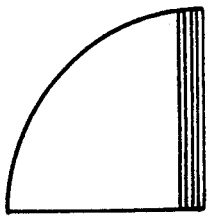
FIG. 15A is a schematic front view of a shade for a gable curve opening, the shade being shown in its open position.
Figure 15B:
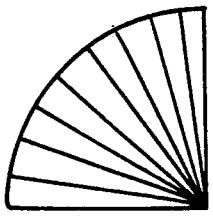
FIG. 15B is a schematic front view of the shade shown in FIG. 15A in its closed condition.

FIGS. 15A and 15B show an alternative way of dealing with a gable-shaped opening. For this embodiment of the invention, the pivot point is at the right-angle corner 120 of the shade, the moveable bar or rail being the rail 122 on the bottom of the shade and the fixed rail being the rail 124 along the right edge of the shade. With this embodiment, radial cords would be provided to control the stacking. Lifting could be accomplished with a cord such as the cord 126 shown in FIG. 15B.

Figure 16A:
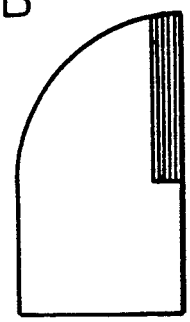
FIG. 16A is a schematic front view of a shade in its open condition for a gable curved opening with a rectangular lower portion.
Figure 16B:
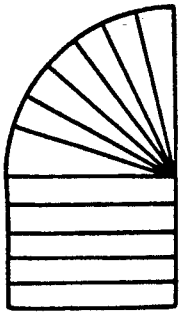
FIG. 16B is a schematic front view of the embodiment of the invention shown in FIG. 16A in its closed position.

FIGS. 16A and 16B show still another embodiment of the invention wherein the opening includes a rectangular portion 130 topped by a gabled portion 132. Lifting for the rectangular portion of this shade would be substantially as described, for example in conjunction with FIG. 17, and lifting for the gable portion 132 of this shade would be accomplished in a manner similar to that described in conjunction with FIGS. 15A and 15B.

While the invention has been described above with respect to a number of embodiments, it is apparent that the teachings of this invention could be adapted to construct shades for covering a variety of other opening shapes. For example, two shades of the type shown in FIG. 17 could be combined to cover an opening having a top in the form of a pointed arch. Two or more shades of the type shown in FIG. 13 could be utilized to cover an opening having a top in the form of a curved arch. Further, as has been discussed in conjunction with the various embodiments, there is wide latitude in the selection of cording for a given shade and in the selection of spacers where such are required.

Thus, while the invention has been described above with reference to preferred embodiments thereof, the foregoing and other changes of form and detail may be made therein by one skilled in the art without departing from the spirit and scope of the invention.

What is claimed is:

1. A pleated shade operable between an open position to expose an opening and a closed position to cover the opening, the opening having a non-rectangular shape, comprising:

a fixed bar shaped and angled to conform to at least a portion of a first edge of said opening;

a movable bar shaped, positioned and angled to conform to a second edge of said opening when the shade is in its closed position, said first and second edges not being parallel; pleated material connected at one end to said fixed bar and at its other end to said moveable bar and adapted to cover said opening when the shade is in its closed position;

at least one row of openings formed in said material and in the bars adjacent which openings are aligned to substantially conform to a preferred direction of movement of the shade when the shade is being opened;

first cords passing through each of said rows of openings, said first cords being adapted to control the stacking of said pleated material;

second cords adapted when operated to open and close the shade;

means for connecting said first and second cords in a manner to compensate for the differences in the rate of travel of the cords when the cords are operated; and means, including at least in part said connecting means, for assuring that most of the weight of the shade is bourne by the second cords and that little if any weight of the shade is borne by the first cords.

2. A shade as claimed in claim 1 wherein said row of openings is a radial row of openings.

3. A shade as claimed in claim 1 wherein said fixed bar is mounted to a straight edge of said opening; and including means operative at a selected point in the travel of said movable bar between the open and closed positions of said shade to cause said lower bar to pivot through a predetermined angle to cause said bars to be substantially parallel when the shade is in its fully open position.

4. A shade as claimed in claim 3 wherein said first and second edges of the opening substantially meet at one end; and including means for pivotably linking said fixed and movable bars proximate said one end.

5. A shade as claimed in claim 4 wherein said row of openings is a radial row of openings; and wherein the center of curvature for at least one radial row of openings is substantially at the pivot point for said bars.

6. A shade as claimed in claim 4 wherein the pleated material is a rectangular sheet which, when connected between said bars, forms an arch shape with a radial free boundary.

7. A shade as claimed in claim 4 wherein the pleated material is a rectangular sheet having free boundary cut to provide a straight vertical free boundary.

8. A shade as claimed in claim 3 wherein there is a predetermined vertical spacing between the bars at their near end;

wherein the selected point in the travel of the movable bar is a point where the near ends of the bars substantially meet; and wherein said at least some of said second cords are operative to raise and lower said lower bar in a substantially vertical direction through its travel between the selected point and the closed position.

9. A shade as claimed in claim 8 including intermediate bar means connected to said material and extending in a substantially horizontal direction from a point adjacent the end of said fixed bar nearest said movable bar to the free boundary of the material; and means for pivotably linking said fixed and intermediate bars at their adjacent ends.

10. A shade as claimed in claim 9 wherein there are at least two vertical rows of openings in the material in the portion thereof between the intermediate and the movable bar; and including cords passing through each of said openings and the bars adjacent thereto and adapted when operated to move the movable bar between the closed position and a position adjacent the intermediate bar.

11. A shade as claimed in claim 10 wherein there is at least one vertical row and at least one radial row of openings in the portion of said material between the fixed and the intermediate bars; and wherein second cords passing through at least one of said vertical row of openings are operative to pivot said movable bar and said intermediate bar to cause said bars to be substantially parallel to said upper bar when the shade is in its open position.

12. A shade as claimed in claim 1 including means operative at a selected point in the travel of said movable bar between the open and closed positions of said shade to cause said movable bar to pivot about a predetermined axis to bring said bars substantially parallel to each other.

13. A shade as claimed in claim 12 wherein said second edge is the upper edge of said opening and is substantially horizontal; and wherein said first edge is the lower edge of said opening and is at an angle to the horizontal, being nearer the upper edge at one end then the other.

14. A shade as claimed in claim 13 wherein said upper and lower edges of the opening substantially meet at one end; and including means for pivotably linking said fixed and movable bars proximate said one end.

15. A shade as claimed in claim 14 wherein said row of openings is a radial row; and wherein the center of curvature for at least one of said radial rows of openings is substantially at the pivot point for said bars.

16. A shade as claimed in claim 14 wherein the pleated material is a rectangular sheet which, when connected between said bars, forms an arch shape with a radial free boundary.

17. A shade as claimed in claim 14 wherein the pleated material is a rectangular sheet having a free boundary cut to provide a straight vertical free boundary.

18. A shade as claimed in claim 13 wherein there is a predetermined vertical spacing between the bars at their near end;

wherein the selected point in the travel of the movable bar is a point where the near ends of the bars substantially meet; and wherein at least some of said second cords are operative to raise and lower said movable bar in a substantially vertical direction through its travel between the selected point and the closed position.

19. A shade as claimed in claim 18 including intermediate bar means connected to said material and extending in a substantially horizontal direction from a point adjacent the end of said fixed bar nearest thereto and the free boundary of the material; and means for pivotably linking said fixed and intermediate bars at their adjacent ends.

20. A shade as claimed in claim 19 including at least one vertical row and at least one radial row of openings in the portion of said material between the fixed and the intermediate bars; and wherein the cords passing through at least some of said vertical openings are second cords and are operative to pivot said movable and said intermediate bars to cause said bars to be substantially parallel to said fixed bar when the shade is in its fully open condition.

21. A shade as claimed in claim 1 wherein the first edge of said opening is curved, wherein said movable bar is formed of a flexible material; and wherein said movable bar bends to conform to the shape of said first edge when said shade is in its fully open position.

22. A shade as claimed in claim 21 including means operative at a selected point in the travel of said movable bar between the open and closed positions of said shade to cause said movable bar to pivot about a predetermined axis to cause said bars to be substantially parallel when the shade is in its fully open position.

23. A shade as claimed in claim 22 wherein said first and second edges of the opening substantially meet at one end; and including means for pivotably linking said fixed and movable bars proximate said one end.

24. A shade as claimed in claim 22 wherein there is a predetermined vertical spacing between the bars at their near end;

wherein the selected point in the travel of the movable bar the point where the near ends of the bars substantially meet; and wherein at least some of said second cords are operative to raise and lower said movable bar in a substantially vertical direction through its travel between the selected point and the closed position.

25. A shade as claimed in claim 24 including intermediate bar means connected to said material and extending in a substantially horizontal direction at said selected point, said intermediate bar being formed of a flexible material; and means for pivotably linking said fixed and intermediate bars at their adjacent ends.

26. A shade as claimed in claim 1 wherein said pleated material is formed of at least two sheets which sheets overlap over a short area;

wherein a row of said openings is formed in the overlap portion of each of said sheets of material, the openings in one of said sheets being aligned with the corresponding openings in the other of said sheets; and wherein said first cord means passes through each of the aligned openings and functions to keep the sheets of material together.

27. A shade as claimed in claim 26 wherein said first and second edges of the opening substantially meet at one end; and wherein at least one of said pieces of material is a rectangular piece of material which is fitted between said bars, being pinched together at the end where two edges meet and having an arched boundary at the other end.

28. A shade as claimed in claim 27 wherein there are a plurality of sheets of material which form said pleated material; wherein each sheet of material overlaps the adjacent material over a small area;

wherein there is a row of said openings in the overlap portions of each of said sheets, the openings in each two overlap sheets being aligned and having a first cord passing therethrough which holds the sheets together.

29. A shade as claimed in claim 28 wherein the opening is a right angle triangular opening; and wherein the free boundary of the sheet furthest from the point where the two edges of the opening meet is cut to provide a vertical free boundary.

30. A shade as claimed in claim 28 wherein said first cords and said second cords are connected to form at least one cord loop.

31. A shade as claimed in claim 4 wherein said means for pivotably linking said fixed and movable bars is a cord fixed at either end to said bars and extending through openings formed in the material therebetween.

32. A shade as claimed in claim 1 wherein said means for connecting said cords to compensate includes pulley means, means for connecting at least one of said cords over said pulley means, and means for operating said cords to open and close said shade through said pulley means.

33. A shade as claimed in claim 1 wherein said opening is gable shaped having first and second edges which are at right angles to each other connected by an arch shaped edge; including means for connecting said fixed and movable bars at the point where they meet; and including said second cords, for pivoting said second bar about the junction of the two bars to bring said bars substantially parallel with each other when said shade is in its open condition.

34. A shade as claimed in claim 33 wherein said second cords includes a cord extending from the end of said movable bar furthest from said pivot point to the end of said fixed bar furthest from the pivot point.

35. A shade as claimed in claim 1 wherein said opening has a substantially rectangular portion and a substantially gable-shaped portion extending from one end of the rectangular shaped portion;

an intermediate bar positioned substantially at the junction of the two portions;

wherein said first edge is the edge of said gable-shaped portion which is at the junction of said portions;

wherein said second edge is the edge of the rectangular portion which is opposite the junction of the two portions; including means for joining said fixed and intermediate bars at the point where they substantially meet; and wherein said second cords are adapted to move said shade in a substantially vertical direction through the said rectangular portion and are adapted to pivot both said movable bar and said intermediate bar through said gable portion until the bars are all substantially parallel.

36. A shade as claimed in claim 1 wherein one or more of said second cords pass adjacent to a predetermined surface of said material and do not pass through openings formed therein.

37. A shade as claimed in claim 9 including spacer means connected between said intermediate bar and the bar vertically thereabove, said spacer means being of fixed length and limiting the spacing between said bars.

38. A shade as claimed in claim 9 including descender control means, said descender control means including a second cord which is adapted to prevent said intermediate bar and said movable bar from separating when said shade is being closed until said bars have reached said predetermined point in their travel.

39. A shade as claimed in claim 38 wherein said descender control means includes timing means which operates on said second cord to keep said bars together until said predetermined point is reached and to then permit said bars to separate as said shade continues to be closed.

40. A shade as claimed in claim 1 including means for preventing said first cords from having substantial weight applied thereto during movement of said movable bar when said shade is being opened or closed.

41. A shade as claimed in claim 13 wherein said shade is opened by lowering the shade.

42. A pleated shade operable between an open position to expose an opening and a closed position to cover the opening, said opening having at least one of its upper or lower edges slanted, said upper and lower edges being spaced by a predetermined distances at their near ends, comprising:

a fixed bar shaped and angled to conform to the slanted edge of said opening;

a moveable bar shaped, positioned and angled to conform to the opposite edge of said opening when the shade is in its closed position;

pleated material connected at one to said fixed bar and at its other end to said moveable bar and adapted to cover said opening when the shade is in its closed position;

an intermediate bar attached to the material and extending horizontally from a point substantially at the near end of the fixed bar;

means for pivotably connecting the fixed and intermediate bars at their near ends;

at least one radial row of openings formed in said material in the portion thereof between said fixed and intermediate bars;

at least one straight, vertical row of openings formed in the portion of said material between said intermediate bar and said moveable bar;

cord means comprising a plurality of cords for controlling the opening and closing of the shade and for controlling the stacking of the material, at least one cord of the cord means passing through said radial row of openings and at least one cord of the cord means passing through the straight row of openings to control the stacking of said material in the respective portions, and at least one cord of the cord means being adapted when operated to move the shade in a substantially vertical direction in the portion thereof between the moveable and intermediate bars and to pivot said moveable and intermediate bars about said means for pivotally connecting through the portion of the shade between the intermediate bar and the fixed bar, whereby, when said shade is in its opened position, said bars are adjacent to each other and substantially parallel;

means for connecting the cords of said cord means in a manner to compensate for differences in the rate of travel of the cords when the cords are operated; and means, including at least in part said connecting means, for assuring that at least most of the weight of the shade is borne by the cord of the cord means adapted to move the shade and that little if any of the weight of the shade is borne by the stacking control cords.

* * * * *

UNITED STATES PATENT AND TRADEMARK OFFICE

CERTIFICATE OF CORRECTION

PATENT NO. : 5,092,383

DATED : March 3, 1992

INVENTOR(S) : REMMELT C. NIEMEIJER, REN JUDKINS

It is certified that error appears in the above-identified patent and that said Letters Patent is hereby corrected as shown below:

Column 16, line 65, claim 33, before "including" insert --means,--.

Signed and Sealed this

Twenty-ninth Day of June, 1993

*Attest:*

Michael K. Kirk

MICHAEL K. KIRK

*Attesting Officer*

*Acting Commissioner of Patents and Trademarks*